US005989121A

United States Patent [19]

Sakamoto

[11] Patent Number: 5,989,121

[45] Date of Patent: Nov. 23, 1999

[54] GAME MACHINE IN CAPABLE OF CONTROLLING GAME ASPECT

[75] Inventor: Yoshikazu Sakamoto, Tokyo, Japan

[73] Assignee: Universal Sales Co., Ltd., Tokyo, Japan

[21] Appl. No.: 08/729,508

[22] Filed: Oct. 11, 1996

[30] Foreign Application Priority Data

Oct. 11, 1995 [JP] Japan ..... 7-288115

[51] Int. Cl.[6] ..... G07F 17/34; A63F 5/04

[52] U.S. Cl. ..... 463/20; 273/143 R; 463/26

[58] Field of Search ..... 463/1, 12–13, 463/16–20, 26–27, 25, 29–30, 40–42; 273/143 R, 121 B, 292–293

[56] References Cited

U.S. PATENT DOCUMENTS

| | | | |
|---|---|---|---|
| 5,123,649 | 6/1992 | Tiberio | 273/143 R |
| 5,178,390 | 1/1993 | Okada | 273/143 R |
| 5,393,061 | 2/1995 | Manship et al. | 463/20 |
| 5,603,659 | 2/1997 | Okada | 463/16 |
| 5,655,961 | 8/1997 | Acres et al. | 463/25 |
| 5,722,891 | 3/1998 | Inoue | 463/20 |

FOREIGN PATENT DOCUMENTS

| | | |
|---|---|---|
| 8-84805 | 4/1996 | Japan . |
| 8-280872 | 10/1996 | Japan . |

*Primary Examiner*—Valencia Martin-Wallace
*Assistant Examiner*—Mark A. Sager
*Attorney, Agent, or Firm*—Pillsbury Madison & Sutro LLP

[57] ABSTRACT

This invention aims to provide a game machine which can offer exciting and varied game aspect. In the game machine, certain symbol combinations (group [C] and [E]) are set as a prize mode only when they occur in B.B (big bonus) game. The combinations in group [C] are not regarded as a prize mode when they occur during the ordinary regular game. These combinations are new to the player because the player encounters them only when the game shifts to the big bonus game. This gives a fresh impact to the player and the player can enjoy a variety in the big bonus game, which does not occur in the ordinary regular game.

5 Claims, 11 Drawing Sheets

FIG. 5

| Game Mode / Number of Coin | During B.B Game | Under B.B Flag Set | During Regular Game |
|---|---|---|---|
| 1 | $T_{B1}$ | $T_{F1}$ | $T_{S1}$ |
| 2 | $T_{B2}$ | $T_{F2}$ | $T_{S2}$ |
| 3 | $T_{B3}$ | $T_{F3}$ | $T_{S3}$ |

FIG. 6

| Code No. | First Reel | Second Reel | Third Reel |
|---|---|---|---|
| 1 | A | A | A |
| 2 | E | G | G |
| 3 | D | E | E |
| 4 | G | F | D |
| 5 | E | G | A |
| 6 | C | B | G |
| 7 | F | G | E |
| 8 | D | E | D |
| 9 | G | F | C |
| 10 | E | G | G |
| 11 | B | D | E |
| 12 | E | F | D |
| 13 | D | E | B |
| 14 | G | F | G |
| 15 | E | G | E |
| 16 | C | C | D |
| 17 | G | D | B |
| 18 | E | F | G |
| 19 | D | G | E |
| 20 | G | E | F |
| 0 | E | F | D |

GAME MACHINE IN CAPABLE OF CONTROLLING GAME ASPECT

BACKGROUND OF THE INVENTION

1. Field of the Invention

This invention relates to a game machine having a controller, such as a microcomputer, to control the game aspect. More particularly, this invention relates to a game machine which has a variable display for displaying a plurality of symbols in a variable manner.

2. Related Art

In the game machine with such a variable display, prize is generally determined by a random sampling. Prizes given to a player based on the prize determination has various modes. For example, slot machine has a small hit mode, besides the regular game mode, which offers a small hit prize. Small hit occurs when a prescribed combination of symbols appears on the variable display during the regular game. With a small hit, a given number of coins are returned to the player.

There is also a medium hit mode to offer a medium hit prize. The game in this mode is called a normal bonus game (referred to as N.B game). Normal bonus (N.B) game takes place when a prescribed combination of symbols, which differ from the small hit symbol combination, appears on the display during the regular game. With a medium hit, the player can play an extra game called a "bonus game" once. The bonus game is composed of a set of several rounds of high bonus games.

There is also a big hit mode which offers a big hit prize. The game in this mode is called "big bonus game" (referred to as B.B game). This takes place when a prescribed combination of symbols, which is different from small or medium prize symbol combinations, appears on the variable display. With a B.B game, player can play several sets of regular games in which the small hit occurs with a high probability and the bonus game mentioned above.

The regular games in the B.B game are played several times before the game shifts to the bonus game. During the regular games in the B.B game, the small hit occurs with a high probability. A given number of coins are returned to the player every time the small hit symbol combination appears on the variable display. The player will finally win a number of coins with the B.B game. If none of these prize modes occurs during the game, the game is a non-prize mode and the player cannot win the game.

However, in the conventional game machine, the small hit, which occurs in the regular game of the B.B game with a high probability, is determined in the same combination of symbols as the small hit in the ordinary regular game. That is, even when the game shifts from the regular game to the B.B game, there is no variation in the prize composition using the same small hit mode until the game shifts to the bonus game. Variety and excitement were not satisfactory in the game flow of the conventional game machine.

SUMMARY OF THE INVENTION

This invention was conceived to overcome such issues, and aims to provide a more exciting and varied game machine. The game machine comprises a variable display for displaying a plurality of symbols in a variable manner. A controller controls prize symbol combinations which moves, stops and appears on the display in response to a prize mode determined based on random number sampling. The controller also controls game aspect to execute a regular game, in which a variety of bonus prizes may occur, and a specific prize game, which occurs during the regular game and consists of several rounds of high bonus games. As a feature of the invention, the controller brings an additional prize mode during the specific prize game. This prize mode is regarded as a non-prize mode and does not offer any bonus when it occurs during the ordinary regular game, but it offers bonus only when it occurs in the specific prize game.

Thus, the non-prize mode which does not offer any bonus during the ordinary regular game changes to a wining mode offering a bonus only when it occurs in the specific prize game. The player can enjoy the variation in the game, and the game becomes more exciting and fun.

Japanese patent application H07-288115, filled by the same applicant on Oct. 11, 1995, is hereby incorporated into this specification by reference.

BRIEF DESCRIPTION OF DRAWINGS

FIG. 5 conceptually illustrates a prize determination table used in the embodiment of the invention.

FIG. 6 conceptually illustrates a symbol table used in the embodiment.

DESCRIPTION OF THE PREFERRED EMBODIMENT

The invention will now be described in detail with an example of slot machine.

Figure 1:
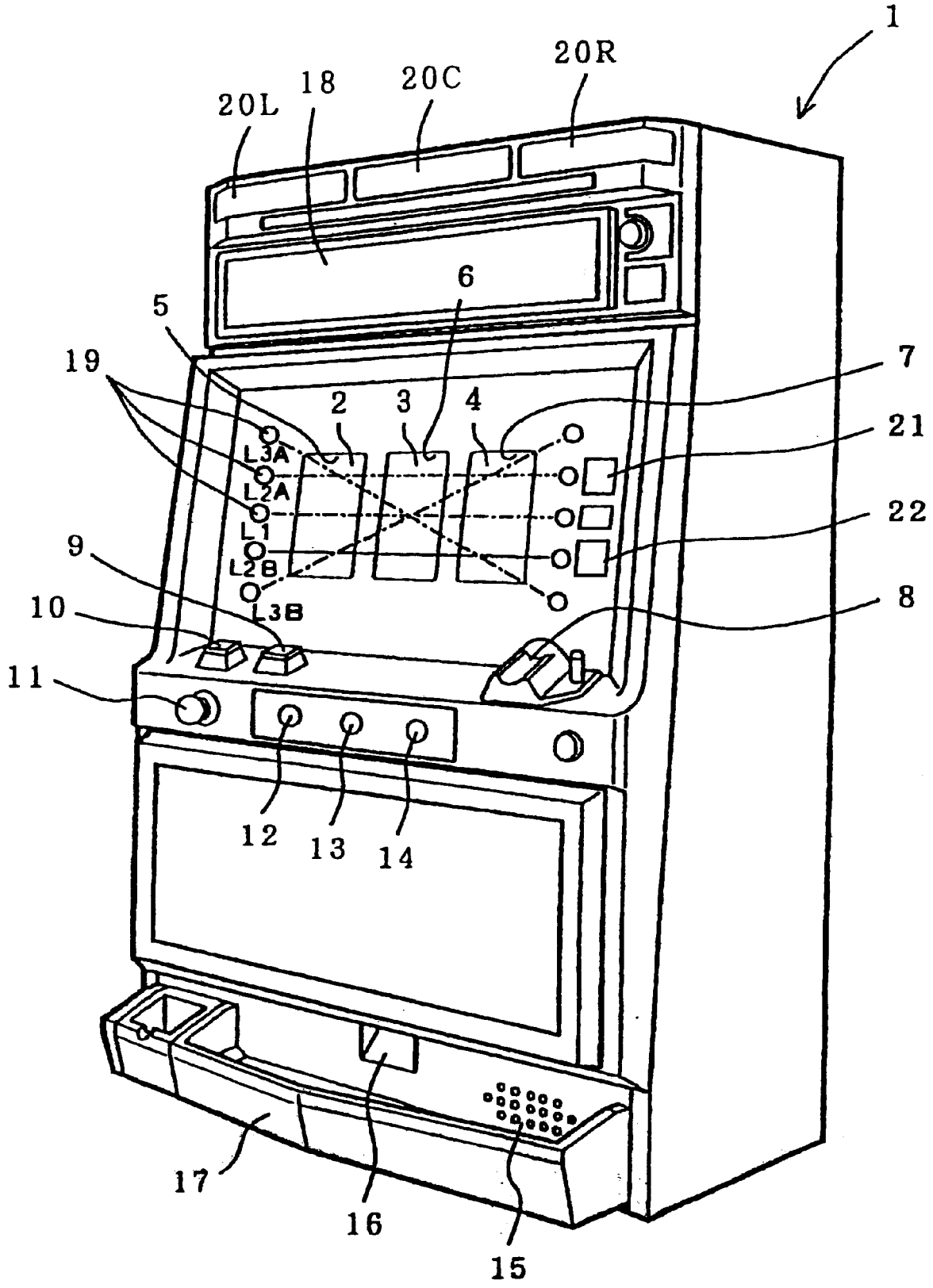
FIG. 1 is a perspective view showing the appearance of the slot machine according to the embodiment of the invention.

FIG. 1 is a perspective view of the slot machine according to the preferred embodiment. Three rotatable reels 2, 3, and 4 are provided in the center of the slot machine 1. Three reels 2, 3 and 4 make a variable display. Various kinds of pictures(symbols) are illustrated at each column of symbols along the periphery of each of the reels 2, 3 and 4. At each column (each reel), three symbols can be seen through a display window. Therefore, 3×3 symbol matrix can be seen through the display windows 5, 6 and 7, which are provided on the front face of the slot machine 1 corresponding to the respective reels 2, 3 and 4. A slot 8 is positioned right foot of the display windows 5, 6 and 7, through which a game medium (substitute money), such as a coin, medal or token, is put in. In the preferred embodiment, coin is used as a game medium. Across the display windows 5, 6 and 7, three horizontal prize-lines (indicated by dotted broken lines L2A, L1, and L2B from the top) and two diagonal prize-lines (L3A having a negative slope and L3B having a positive slope) are formed. When a player inserts a coin through the slot 8, only the center prize-line L1 functions. When two coins are put in the slot 8, the upper and lower horizontal prize-lines L2A and L2B become available. Inserting three coins makes all the prize-lines L1, L2A, L2B, L3A and L3B function. Availability of prize-lines is indicated to the player by turning on the corresponding effective prize-line indication lamps 19 provided both sides of the each prize-line.

The slot machine 1 has a BET switch 9, a credit/pay-back switch 10, a start lever 11, and stop buttons 12, 13, 14 under the display windows 5, 6, 7. If some coins are on credit and the number of coins is indicated on a credit point indicator 21 (which will be described below), the player can bet at most three coins on a game by operating the BET switch 9, instead of inserting a coin through the slot 8. The player can select credit or pay-back of coins by operating the credit/pay-back switch 10. Operating the start lever 11 causes the reels 2, 3 and 4 to rotate all together. The stop buttons 12, 13 and 14 are provided corresponding to the reels 2, 3 and 4, respectively. The stop buttons 12, 13 and 14 become effective when the rotational rate of the reel reaches a certain level, and then, the player can stop the reel rotation at a desired timing by operating the stop buttons 12, 13 and 14.

The slot machine 1 has sound-through holes 15 and a coin saucer 17 at the bottom front. The sound-through holes 15 lets the sound out, which is generated internal by the built-in speaker. The coin saucer 17 receives coins discharged from a coin pay-back opening 16. A payout table 18 is displayed at the top front of the slot machine 1 to indicate the amount of coins paid back for each prize. Three indication lamps 20L, 20C and 20R (from the left) are provided above the payout table 18. The Credit point indicator 21 which indicates the current number of coins on credit and a bonus coin number indicator 22 which indicates the number of coins paid back to the player for each prize are positioned vertically apart from each other on the right end of the front face of the slot machine 1. These indicators are composed of a certain number of seven (7) segment LEDs. The number of LEDs corresponds to the number of the digits of the displayed value.

Figure 2:
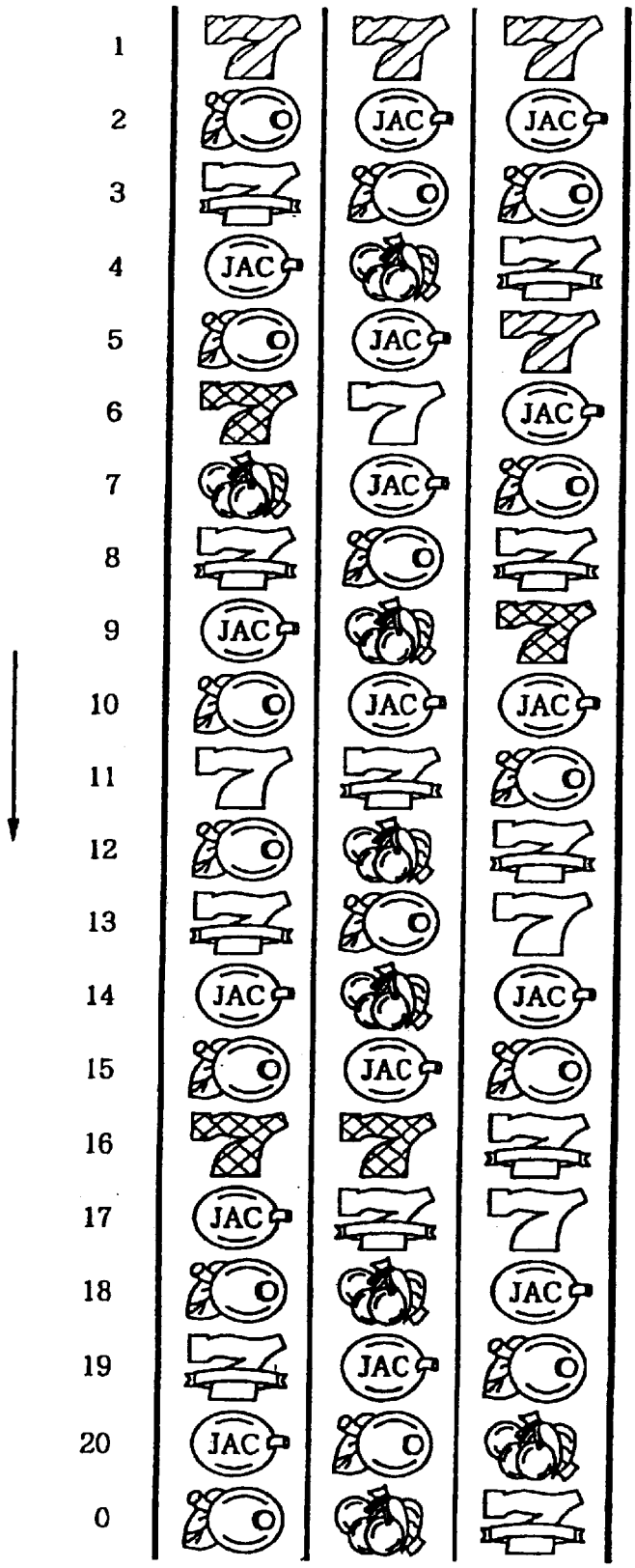
FIG. 2 shows symbol columns illustrated along the periphery of the reels which make up the variable display of the slot machine of the invention.

FIG. 2 shows symbol columns illustrated on the periphery of the reels 2, 3 and 4. Each symbol column includes 21 symbols consisting of several different kinds of pictures. The columns correspond to the reels 2, 3 and 4, respectively, from the left. Each symbol has a code number selected from 0 to 20. The reels 2, 3 and 4 rotate so that the symbol columns move in the direction of arrow in FIG. 2. The hatched lines of the three "7"s with a code number 1 represent red color, and the meshed lines of "7" at left column, code number 6, is blue. The "7" with a ribbon at left column, code number 3, is colored with yellow. That is, there are four kinds of "7"s, white, red, blue and yellow (with ribbon). The same applies to the table in FIG. 3.

Figure 3:
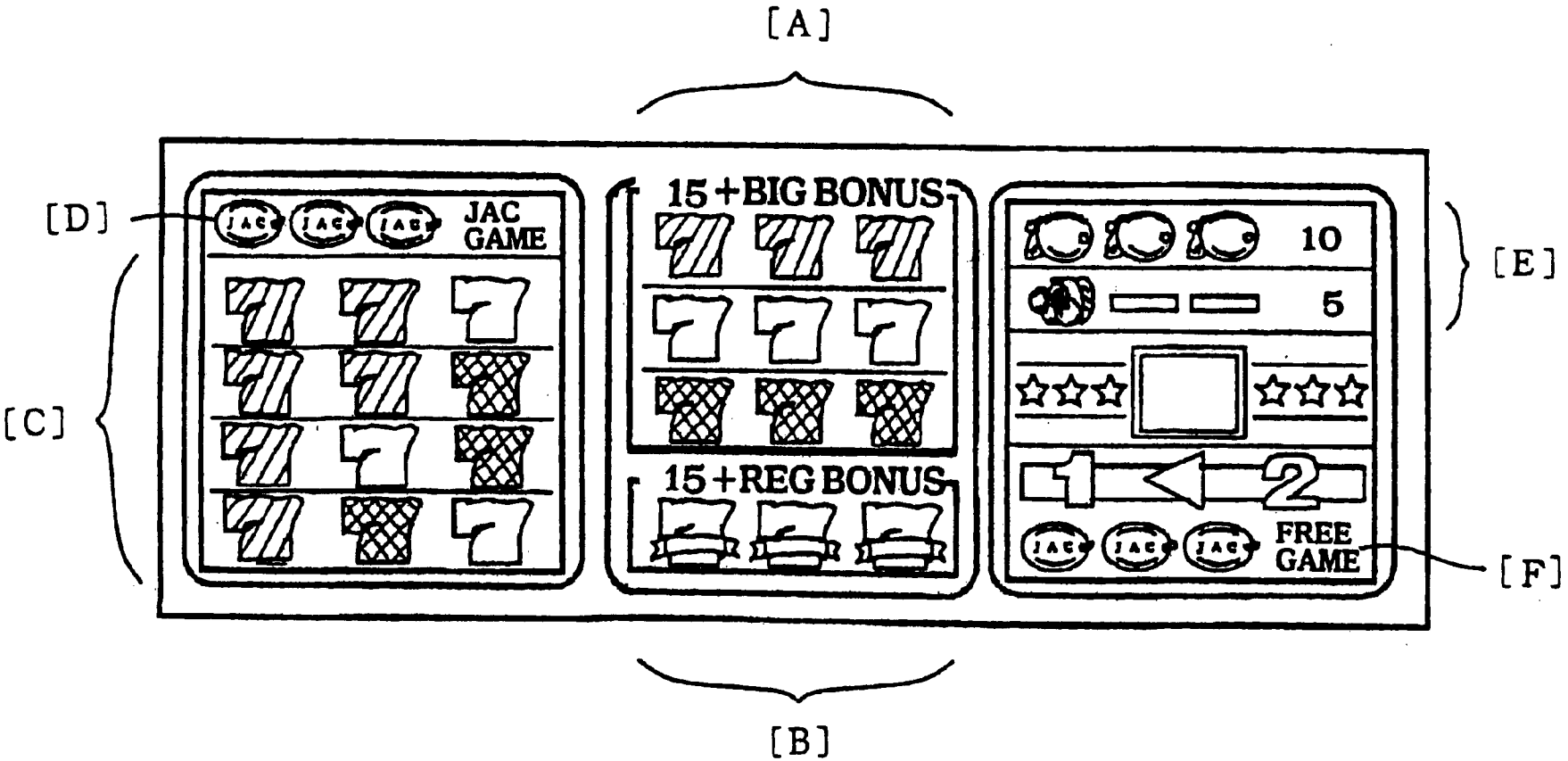
FIG. 3 shows symbol combinations illustrated on the payout table of the slot machine.

FIG. 3 shows a payout table 18 positioned at the top front of the slot machine 1, showing prescribed symbol combinations for the respective prizes. Three symbol combinations belonging to group [A] are big hit combinations which offer a B.B game. When any one of these combinations appears on any one of the prize-lines (described above), the player receives fifteen (15) bonus coins and can shift to the B.B game. The probability of B.B game occurrence is the same among the three combinations of group [A]. A single combination of group [B] is a medium hit combination to offer a N.B game. When this symbol combination lines up on any one of the prize-lines, the player receives fifteen bonus coins, and can shift to the N.B game. Four combinations in group [C] are peculiar to the present invention. These symbol combinations become small hit combinations only when they occur during the regular game rounds in the B.B game. These combinations are regarded as non-prize combinations when they occur in games other than the B.B games. If any one of these combinations lines up on a prize-line during the regular game round of the B.B game, fifteen bonus coins are paid back to the player. The probability of occurrence of these combinations during the regular game round of the B.B game is set high.

A single combination belonging to group [D] causes the game to shift from the regular game to a bonus game in the B.B game. This combination also becomes a jack game prize when three "JAC"s line up along the center horizontal prize-line L1 during the bonus game. Two combinations in group [E] are small hit combinations which occur during the ordinary regular games and during the B.B regular games. When these symbol combinations line up on a prize-line, ten or five coins are given to the player. A combination in group [F] offers a replay game. When this combination appears on a prize-line, the respective reels 2, 3 and 4 automatically start rotating all together without paying back coins, and the player can play a game one more time.

The regular game (1), the B.B game (2), and the N.B game (3) will be described in more detail below.

(1) Regular Game

During the regular game, when the combination belonging to groups [A], [B], [E] or [F] appear on a prize-line, a prize game occurs. If the symbol combination upon the reel stop belongs to none of these groups, no prize occurs (no bonus is offered). When a prize game of any one of groups [A], [B] or [E] occurs, corresponding number of coins are paid back to the player. With the prize game of groups [A] or [B], after coins are paid back, player can play the B.B (big hit) game or the N.B (medium hit) game, respectively. In the B.B game and the N.B game, several times of high bonus games occur concentrically, details of which will be described below. With the prize of group [E], a small hit occurs and the player can receive coins, but no subsequent prize game is offered. When the replay prize occurs with a combination of group [F], player can play a game one more time without inserting a coin.

(2) B.B Game (i) In the B.B game, several rounds of regular games can be played. In the B.B regular games, small hit of group [E] occurs with a higher probability than in the ordinary regular game, although non-prize may also occur. Furthermore, as a feature of the present invention, small hit of group [C] occurs only during the B.B regular game. The combinations of group [C] are not regarded as prize modes when they occur in the ordinary regular games.

(ii) If the combination of group [D] (JAC—JAC—JAC) occurs during the B.B regular game, six coins are paid back to the player.

(iii) Then, the game shifts to the bonus game consisting of a set of games, in which several times of high bonus games occur concentrically. The player can bet a coin on the bonus game. If the symbol combination of group [D] occurs again during the bonus game, fifteen coins are paid back to the player as a JAC prize. Although non-prize game may also occur in the bonus game, the probability of occurrence of JAC prize is as high as 9/10 in the bonus game. In the preferred embodiment, the bonus game is over when the JAC prize has occurred eight times, or when the total game numbers in the bonus game reaches twelve.

(iv) When the bonus game is over, the B.B mode regular game (described in (i)) starts again. If the combination of group [D] described in (ii) occurs again during the B.B. mode regular game, coins are paid back and the game shifts to the bonus game described in (iii) again. In other words, the B.B game is a repetition of a series of regular games and bonus games explained in (i) through (iii). The number of repetition is determined in advance. In the embodiment, when two sets of a series of regular games and bonus games are accomplished, the B.B game is over. Also, the B.B game is over when the total game number played in the regular game modes (i) and (ii) (i.e., the total game number played out of the bonus game of (iii)) exceeds a predetermined number. In the embodiment, this number is set to 30.

(3) N.B Game

The N.B medium hit game offers a set of bonus games described in (iii) of the B.B game. Therefore, the N.B game is over when a set of bonus games has been done. In the N.B game, the regular game offering the small hit with a high probability, described in (i) and (ii), is not played, unlike the B.B game.

Figure 4:
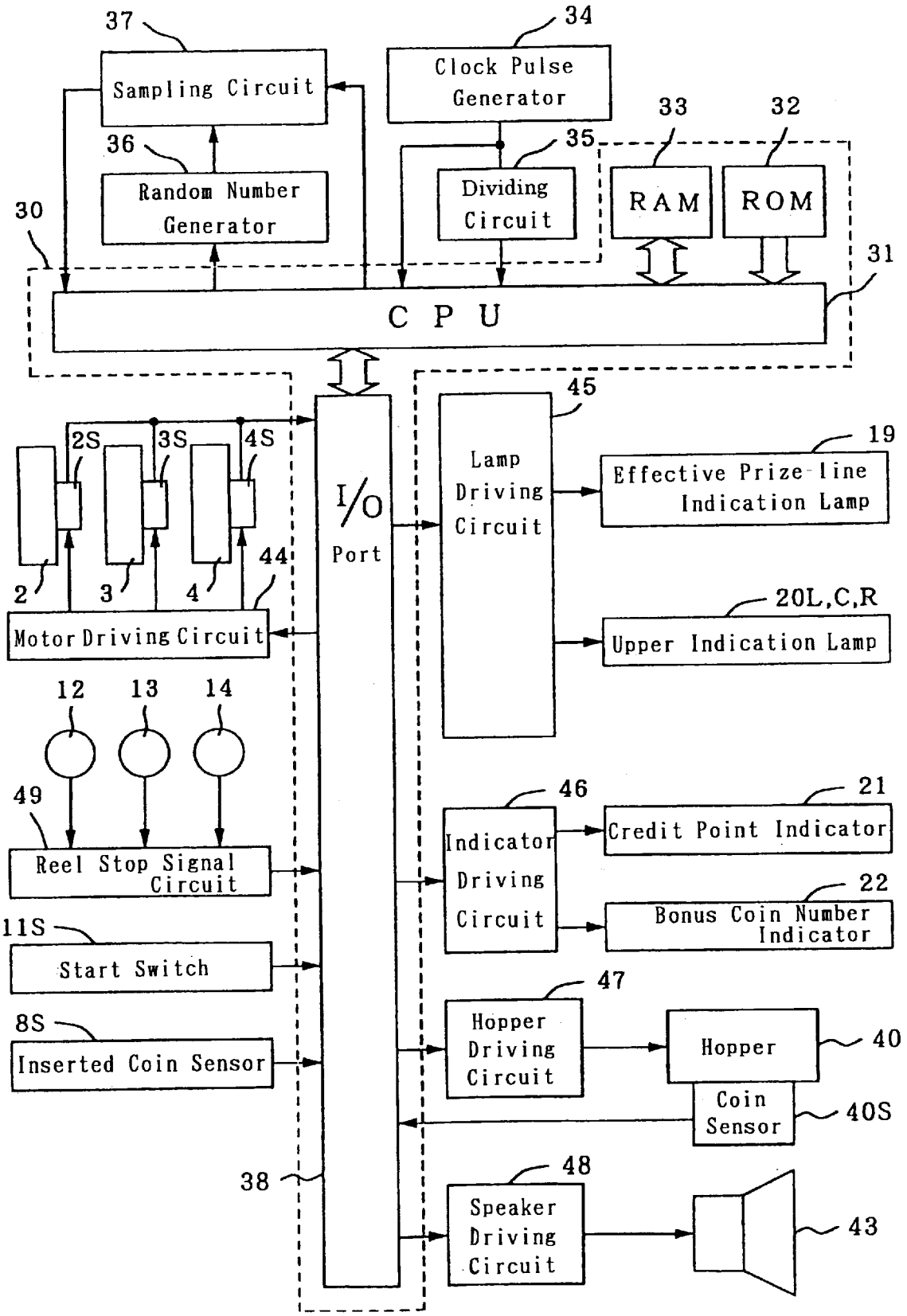
FIG. 4 is a block diagram showing the circuit structure of the slot machine.

FIG. 4 is a circuit diagram showing the controller for controlling the game process of slot machine 1, and peripheral units (actuators) electrically connected to the controller.

The controller includes a microcomputer 30, as a major element, and a random number sampling circuit. The microcomputer 30 comprises a CPU 31 for controlling operations based on the prescribed program, and ROM 32 and RAM 33 as a memory means. The CPU 31 is connected to a clock pulse generation circuit 34 for generating a reference clock pulse, a dividing circuit 35, a random number generator 36 for generating a certain range of random numbers, and to a random number sampling circuit 37 for sampling a random number among the generated random numbers. A I/O port 38 for inputting and outputting a signal from and to the actuator (which will be described below) is also connected to the CPU 31. Storage space of the ROM 32 is divided into several spaces to store a prize determination table, a symbol table, a prize symbol combination table and a sequence program. These tables will be described below.

Major actuators, whose operations are controlled by the control signal from the microcomputer 30, include stepping motors 2S, 3S and 4S for rotating the reels 2, 3 and 4, respectively, the effective prize-line indication lamps 19, the upper indication lamps 20L, 20C, 20R, the credit point indicator 21, the bonus coin number indicator 22, a hopper 40 for receiving coins, and the speaker 43. These units are driven by a motor driving circuit 44, a lamp driving circuit 45, a indicator driving circuit 46, a hopper driving circuit 47, and a speaker driving circuit 48, respectively. The driving circuits 44–48 are connected through the I/O port 38 of the microcomputer 30 to the CPU 31.

The microcomputer 30 requires various inputs from many units (as signal generators) to generate a control signal. These signal generators include a coin sensor 8S for detecting a coin inserted through the coin slot 8, and a start switch 11S for detecting manipulation of the start lever 11. Signal generators also include reel rotation sensors for generating reset pulses every time the reels 2, 3 and 4 make a rotation, and reel position detectors for detecting the rotational positions of the reels 2, 3 and 4 based on the output pulse from the reel rotation sensors. The reel rotation sensors and the reel position detectors are included in the driving mechanism (not shown) of the reels 2, 3 and 4. The reel position detectors count the numbers of driving pulses supplied to the stepping motors 2S, 3S and 4S when the reels 2, 3 and 4 start rotating, and write the count values in predetermined areas in the RAM 33. When a reset pulse from the reel rotation sensor is supplied to the CPU 31 through the reel position detector, the driving pulse count value stored in the RAM 33 is cleared to "0". The RAM 33 stores count values corresponding to the rotational positions for the respective reels 2, 3 and 4, the rotational position being limited within one rotation.

Signal generators mentioned above also include a reel stop signal circuit 49 which generates a signal for stopping the corresponding reel when each of the stop buttons 12, 13 and 14 is depressed. A coin sensor 40S, which counts the coins paid back from the hopper 40, and a pay-back finishing signal generator (not shown) are also included. The pay-back finishing signal generator generates a signal when the count of the actual pay-back supplied from the coin sensor 40S reaches the bonus coin number indicated by a count signal supplied from the display driving circuit 46. Each of these circuits which make up the input signal generator is connected to the CPU 31 through the I/O port 38.

In the embodiment (FIG. 4), the random number generator 36 and the random number sampling circuit 37 are used, independent from the microcomputer 30. However, the system may be designed so that random number sampling is executed on the operation program of the CPU 31 of the microcomputer 30. If this case, the random number generator 36 and the random number sampling circuit 37 may be omitted, or may be maintained as a backup for random number sampling operation.

FIG. 5 conceptually illustrates the prize determination table stored in the ROM 32. The prize determination table stores data for grouping a random number, generated by the random number generator 36 within a given range of random numbers, into the corresponding prize mode. The data is defined by the game state and the number of inserted coins. For example, if a coin is inserted during the ordinary "regular Game", TS1 is selected from the table, and a random number generated by the random number generator 36 within the given range is grouped based on the data stored in the table TS1. To determine the prize mode, it is determined which group the random number sampled by the sampling circuit 37 belongs to. In the respective tables TS1, TS2 and TS3 for the ordinary regular game, random numbers are grouped into the B.B game (group [A] in FIG. 3), the N.B game (group [B] in FIG. 3), the small hit game (group [E] in FIG. 3), the replay game (group [F]) and the non-prize game. As the number of inserted coins increases, the probability of prize occurrence becomes high.

If the B.B. game symbol combinations do not line up upon reel stop, although a B.B flag was set upon occurrence of B.B prize as a result of the prize determination, then the game is in the state of "under B.B flag set", which is immediately before the B.B game. In this situation, a table TF1, TF2, or TF3 is selected from the prize determination table, depending on the number of coins inserted through the slot 8. In each of these tables, the sampled random number is grouped into the small hit game (group [E] in FIG. 3), the replay game (group [F]), or the non-prize game. When the game state shifts to the "B.B game", then a table TB1, TB2, or TB3 is selected from the prize determination table, depending on the number of coins inserted through the slot 8. In each of these tables, the sampled random number is grouped into the small hit game (corresponding to groups [C] and [E]), the JAC game (group [D]), and the non-prize game.

FIG. 6 conceptually illustrates the symbol table stored in the ROM 32. The symbol table shows the rotational positions of the respective reels 2, 3 and 4 in association with the symbols. In this table, symbols shown in FIG. 2 are represented using alphabets. More particularly, the symbol table contains code numbers, which are successively assigned every rotational pitch of the reels concerning the reference position in which the reset pulse is generated, and symbol codes representing symbols corresponding to the code numbers. For example, if the first reel 2 stops at the rotational position "6" concerning the reference position, a symbol corresponding to the code "C" will be positioned in the center of the display window 5, with the codes "E" and "F" over and below the "C".

The ROM 32 also stores the prize symbol combination table (not shown). The symbol combination table stores symbol codes representing the prize symbol combinations of FIG. 3, symbol codes representing symbol combinations of "reach spot", prize determination codes representing the respective prizes, the numbers of bonus medals given to the player, and so on. The reach spot combination occurs during the B.B flag set state upon generation of a B.B game request signal to indicate the player of the fact that the B.B game is very close. The prize symbol combination table is consulted when reel stop control is executed to the first, second and third reels 2, 3 and 4, and when the prize is confirmed after all the reels stopped.

Figure 7:
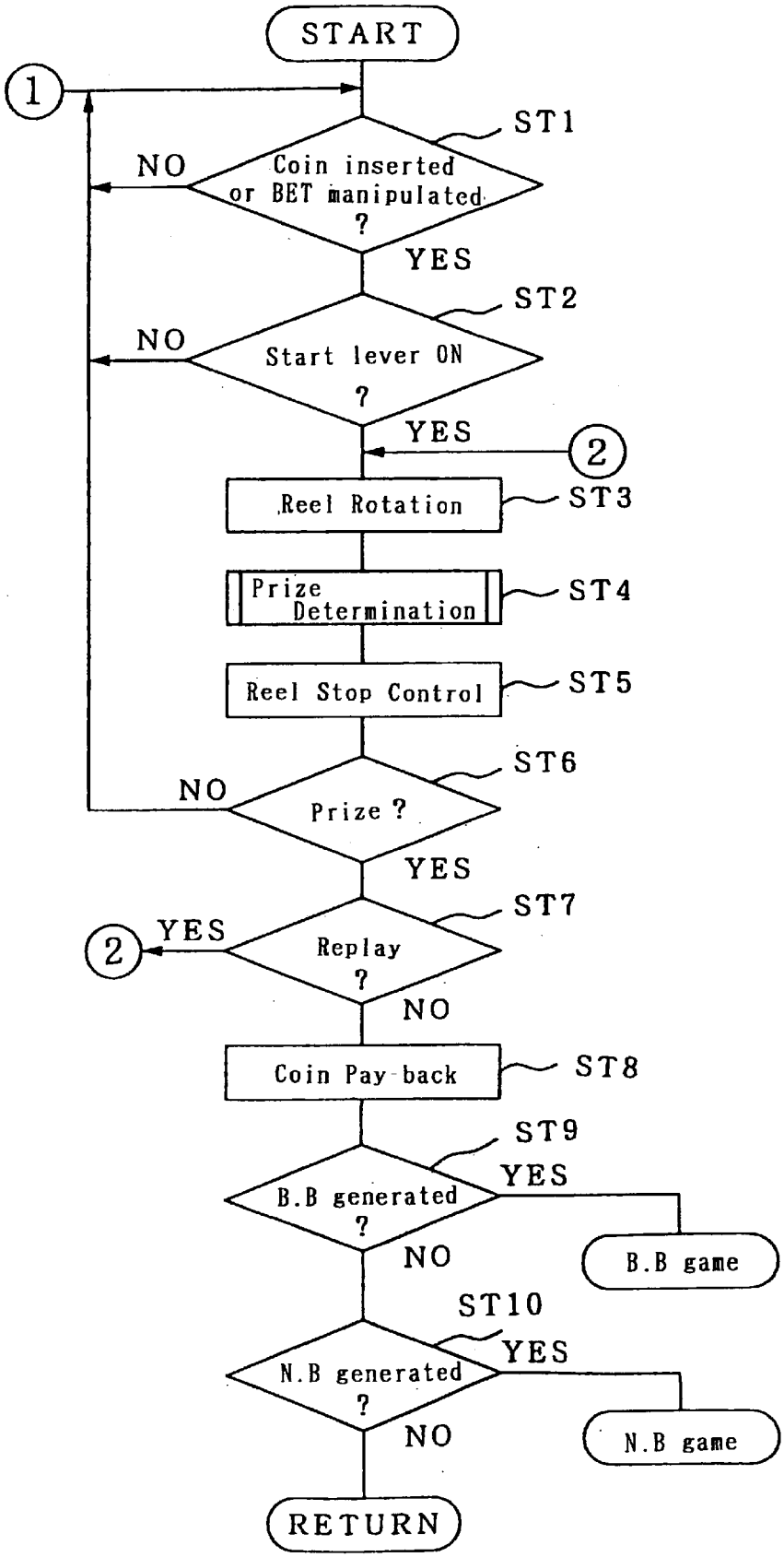
FIG. 7 is a flowchart showing the outline of the operational process of the slot machine according to the embodiment.

The ROM 32 further stores the program (sequence program) used to execute the game in the slot machine 1. Next, the operation of the game machine, which is controlled by the microcomputer 30, will be described about FIG. 7. FIG. 7 is a flowchart showing the process outline of the operation.

At step 1 (ST1), the CPU 31 determines if a coin was inserted, or if the BET switch 9 was manipulated. If the CPU 31 receives a detection signal from the coin sensor 8S, which represents coin insertion through the slot 8, or if the CPU 31 receives a signal from the BET switch 9, the determination result becomes YES. Then, the CPU 31 determines if there is an input (start signal) from the start switch 11S caused by manipulation of the start lever 11 (ST2). If the determination result is YES, the CPU 31 transmits a driving signal through the I/O port 38 to the motor driving circuit 44 to rotate all the reels 2, 3 and 4 (ST3). During the reel rotation, prize determination is executed (ST4), details of which will be described below about FIGS. 8 and 9. Prize determination is executed at an appropriate timing, after the start lever 11 is manipulated, by determining which group of the prize determination table the random number generated by the random number generator 36 and sampled by the sampling circuit 37 belongs to.

The CPU 31 stops the rotation of the reels 2, 3 and 4 based on the type of a prize flag set as a result of the prize determination (ST5). If the symbol combination indicates a prescribed prize mode when the reels stopped, it is determined that the player wins a prize (ST6), and the process proceeds to the next step (ST7). If the player does not win a prize, the determination result at ST6 is NO and the process returns to ST1. During the regular game, when the flag of the B.B game or the N.B game is set and the symbol combination at a reel stop is the prescribed prize combination of group [A] or [B] of FIG. 3, then the B.B game or the N.B game occurs. For example, if the B.B game flag is set, and if the reels stopped showing the combination of three red "7"s (R7—R7—R7 shown at the top of group [A]), then the B.B game occurs. At ST7, it is determined whether the combination indicates the replay game of group [F] of FIG. 3. If YES, the process returns to ST3 and the reels are rotated again. If the combination does not indicate the replay game (i.e., if the determination result is NO), then a predetermined number of coins are paid back (ST8).

Next, it is determined whether the B.B game combination has occurred (ST9). IF the B.B game combination has occurred, the process proceeds to the B.B. game, which is shown in a flowchart in FIG. 10. If no B.B game combination occurs at ST9, then it is determined whether the N.B game combination has occurred (ST10). If the determination result is YES, the process proceeds to the N.B game, which is shown as a flowchart in FIG. 11. When the B.B game or the N.B game combination occurs, fifteen coins are paid back at ST8, and the game shifts to the B.B game or the N.B game, respectively. If the determination result is NO (if the N.B game combination does not occur) at ST10, the process returns to ST1.

The prize determination step of ST4 will be described about flowcharts of FIGS. 8 and 9. First, it is determined whether the current game is in the N.B game or "the bonus game" of the B.B game (ST11). If YES, random number sampling is executed (ST12). Then, it is determined whether the sampled random number is equal to or less than the predetermined value R1 (ST13). Assuming that the range of the random number is from 1 to 16383 and that R1 is 14744, the probability of "random number≦R1"becomes 14744/16383, which is about 9/10. The probability of "random number>R1" is (16383−14744)/16383, which is about 1/10. If the determination result is NO (random number>R1) at ST13, "non-prize" flag is set in the RAM 33 (ST14). If the determination result is YES (random number≦R1), "JAC game" flag is set in the RAM 33 (ST15) and this operation flow is concluded.

If, at ST11, the determination result is NO, then it is determined whether the current game is performed during the B.B game (ST16). If YES, one of the prize tables TB1 to TB3, which is in the B.B game state, is set as a reference table in the RAM 33 (ST17). If the current game is not in the B.B game, then it is determined if the B.B flag has been set (ST18). If the determination result is YES, one of the tables TF1 to TF3, which is in the "Under B.B flag set" state, is set as a reference table in the RAM 33 (ST19). If NO (the B.B flag has not been set), one of the prize tables TS1 to TS3, which is in the regular game state, is set as a reference table in the RAM 33 (ST20). Then, the leading address of the reference table data in the prize determination table is set (ST21).

A random number is sampled within the range of 1 through 16383 (ST22). It is determined if the sampled random number is equal to or less than R2 (ST23). R2 is a comparison reference which is set in the leading data of the prize determination table at ST21, and is used to group the sampled random number into a corresponding prize mode. For example, if the prize determination table is the regular game prize determination table TS1 set at ST20, the comparison reference R2 is set to 44 at the head of the table. If the sampled random number is, for example, 37, the determination result at ST23 becomes YES because the sampled random number is smaller than R2. At the next step ST24, a (B.B game) flag is set for that data (i.e., sampled value 37). The probability of setting this flag is 44/16383, which is about 1/372. If the determination result at ST23 is NO (sampled value>R2), the reference data address of the prize determination table shifts to the next address, and the next address data comparison reference is used as R2 (ST25). Unless the data ends at the next step (ST26), the process returns to ST 23 to compare the sampled random number with the comparison reference R2. When data is over and the determination result at ST26 becomes YES, a "non-prize" flag is set at ST24 without wining any prizes.

Figure 10:
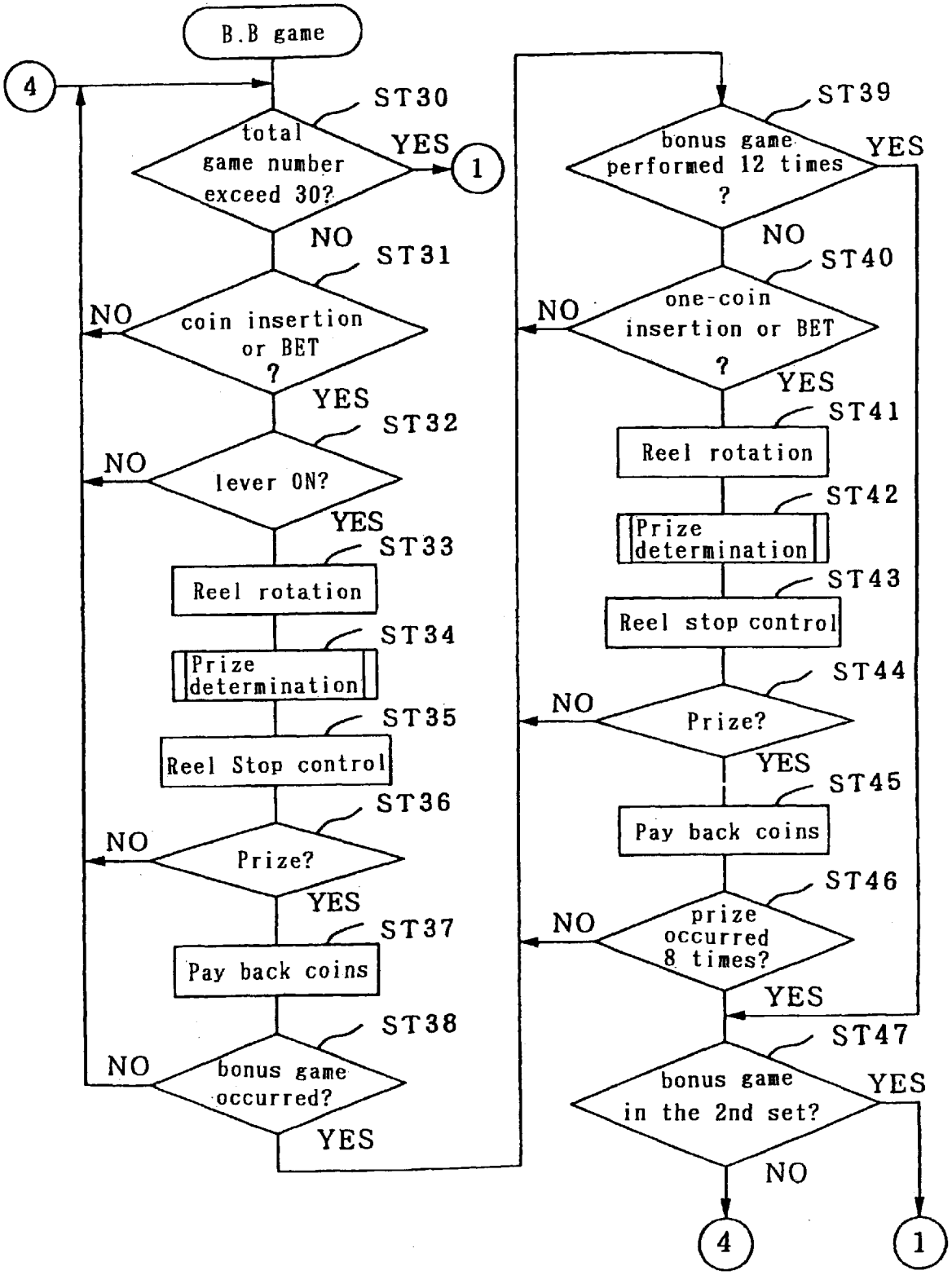
FIG. 10 is a flow chart showing the detailed operational flow of B.B game shown in FIG. 7.

FIG. 10 shows an operational flow of the B.B game. It is determined whether the total number of regular games (non-bonus game) performed during the B.B game exceeds 30 (ST30). If the determination result is YES, the process returns the first step ST1 of the overall operation shown in FIG. 7. If the total game number does not exceed 30, then it is determined if a coin was inserted or the BET switch 9 was manipulated (ST31). This determination is the same as ST1 of FIG. 7. The determination result becomes YES when there is a detection signal from the coin sensor 8S as a result of coin insertion into the slot 8, or when there is a signal input from the BET switch 9. If YES, it is determined if there is a start signal input from the start switch 11S as a result of manipulation of the start lever 11 (ST32). If YES, the CPU 31 transmits a driving signal through the I/O port 38 to the motor driving circuit 44 to rotate the reels 2, 3 and 4 all together (ST33). Then, prize determination is executed (ST34).

Figure 8:
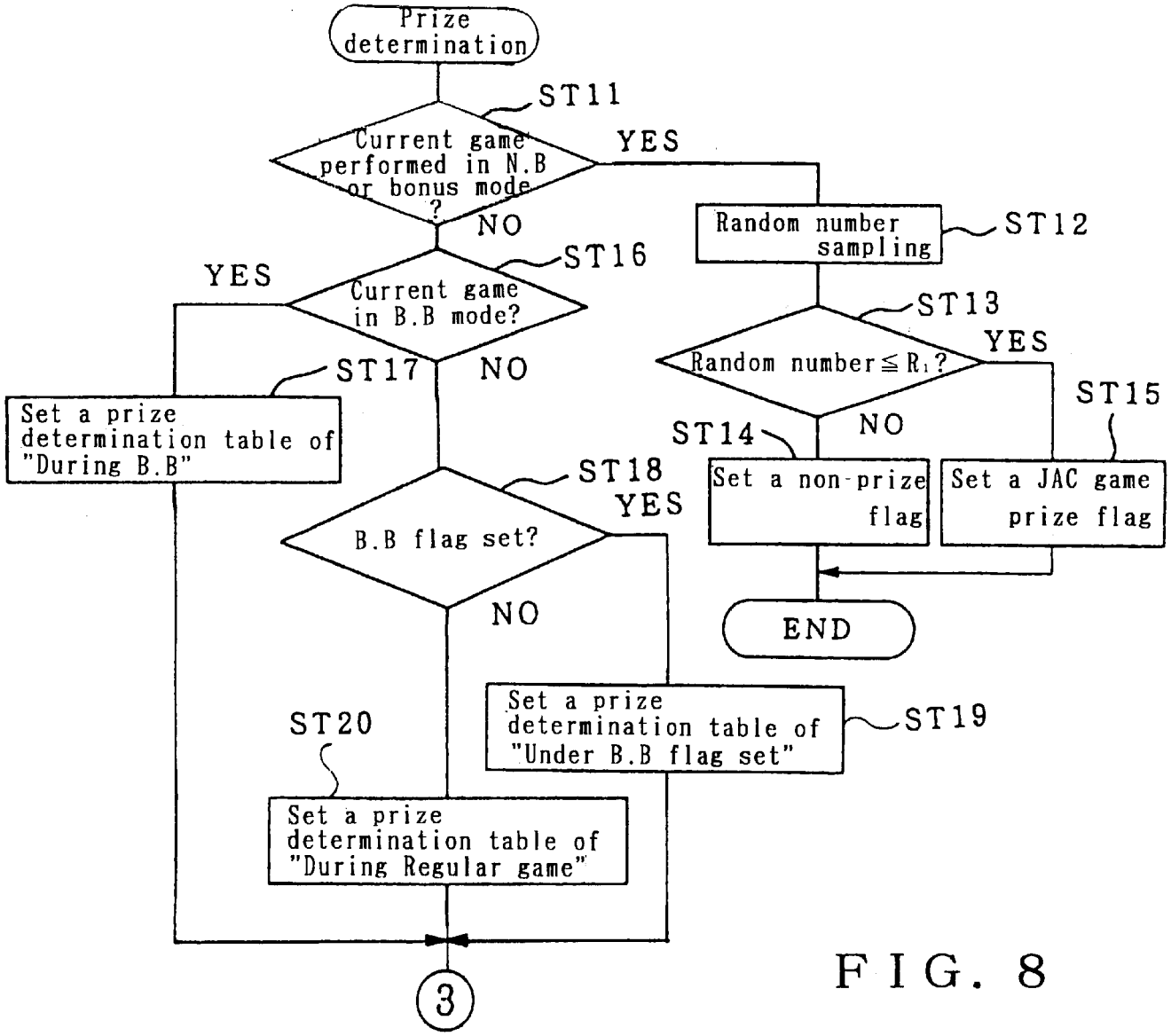
FIG. 8 is a flow chart showing the detailed process of the prize determination in FIG. 7.
Figure 9:
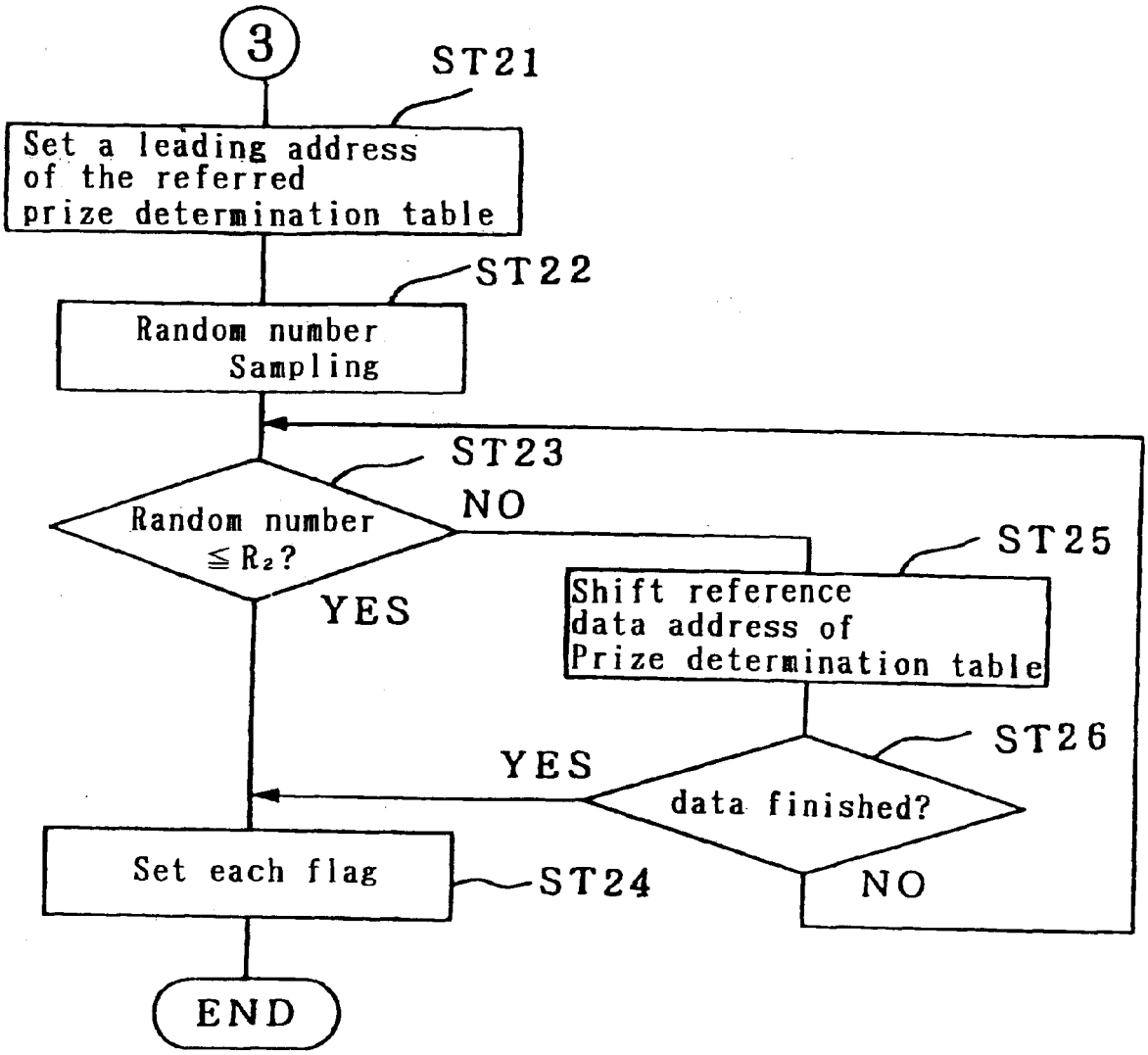
FIG. 9 is a flow chart continued from FIG. 8 and showing the detailed process of the prize determination of FIG. 7.

The prize determination is performed following the steps of the flowcharts of FIGS. 8 and 9, and is based on the determination of ST23 of FIG. 9. That is, during the B.B game, regular game with a three coin bet is executed, in which both non-prize and prize games occur with the probabilities of 1/10 and 9/10, respectively. Since, during the B.B game, the B.B game prize determination table is set at ST17, the small hit symbol combinations of groups [C] and [E] of FIG. 3, and the bonus game shifting combination of group [D] are set as prize combination groups. In the regular game during the B.B game, the symbol combinations of group [C], which are regarded as non-prize modes in the ordinary regular game out of the B.B game, become prize modes with bonus.

The reels are stopped by reel stop control according to the type of the prize flag which was set as a result of the prize determination (ST35). If the symbols displayed upon reel stop indicate one of the prescribed symbol combinations, a prize game occurs (ST36). If no prize game occurs at ST36, the process returns to ST30. Therefore during the B.B game, several times of regular games are repeated. If a prescribed symbol combination appears when the reels stop, a predetermined number of coins are paid back (ST37). If the prize mode is "red 7-red 7-white 7" shown at the top of group [C] of FIG. 3, fifteen coins are paid back. Next, it is determined if the prize mode at ST36 is the symbol combination of group [D] of FIG. 3 (JAC—JAC—JAC) (ST38). If this combination is achieved, the determination result becomes YES and the game shifts to the bonus game. If the determination result is NO, the process returns to ST30.

In a process of the bonus game, it is determined if twelve times of bonus games have been done (ST39). If YES, the process jumps to ST47, where it is determined if the bonus game is the second set. If the two sets of bonus games have been consumed and the determination result at ST47 is YES, the process returns to the first step ST1 of the overall operations shown in FIG. 7. If the determination result at ST47 is NO, the process returns to ST30 to start the second set of regular games.

If twelve times of bonus games have not been accomplished yet at ST39, it is determined if a coin was inserted or the BET switch 9 was manipulated (ST40). In this bonus game, one-coin bet game is performed. If one-coin insertion or BET switch manipulation does not occur (if the determination result is NO), the process returns to ST39. If a coin BET was performed, the determination result becomes YES and all the reels start rotating (ST41). Then, prize determination is executed (ST42). The prize determination is executed following the steps of flowcharts of FIGS. 8 and 9, and is based on the determination of ST13. Then, the reels are stopped by reel stop control in response to the type of the prize flag which was set as a result of the prize determination (ST43). If the symbols displayed upon reel stop indicate a prescribed combination, a prize game occurs and coins are paid back (ST45). If no prize game occurs (at ST44), the process returns to ST39. For example, if a JAC game prize flag is set at the prize determination step ST15, and if the symbol display at the reel stop shows the symbol combination of group [D] of FIG. 3, the JAC game occurs and fifteen coins are paid back. The probability of occurrence of the JAC game is set as high as about 9/10.

It is determined if the JAC games have occurred eighth times (ST46). If the JAC games have not occurred eighth times yet, the process returns to ST39. If the occurrence of the JAC game reaches the eighth time, the determination result is YES at ST46, then it is determined if the bonus game is in the second set (ST47). If NO, the first set of the bonus games are finished and the process returns to ST30 to start the second set of regular games. Namely, if the number of bonus games reaches twelve, or if the number of JAC game prizes reaches eight, the first set of bonus game is over. If the bonus game is in the second set and the determination result at ST47 is YES, the B.B game is over and the process returns to the first step (ST1) of the overall operation. The total regular game number performed in the B.B game is maximum 30 (ST30), and the number of coins obtained during the B.B game is, for example, about 250 coins.

Figure 11:
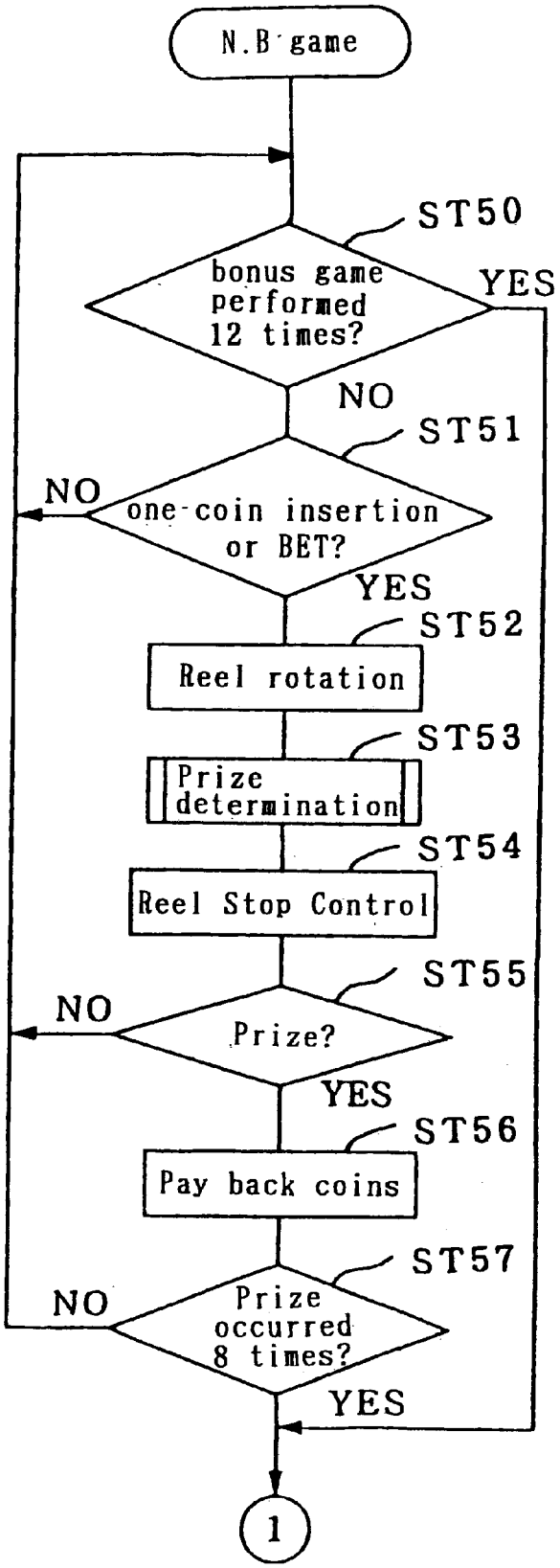
FIG. 11 is a flow chart showing the detailed operational flow of N.B game shown in FIG. 7.

Next, the operation of the N.B game will be described referring to FIG. 11. The process of the N.B game is the same as that of the bonus game in the B.B game, which is shown at ST39 through ST46 of FIG. 10. It is determined that the bonus game has been done twelve times (ST50). If the twelve times of bonus games have not been done, then it is determined if coin BET was made (ST51). If coin BET was made, the reels are driven to rotate all together (ST52), and prize determination is executed (ST53). Reel stop control is performed (ST54) and it is determined if a prize game occurs (ST55). If the symbol combination indicates JAC—JAC—JAC, a prize game occurs and coins are paid back (ST56). It is further determined if the JAC prize game has occurred eight times (ST57). If eight times of JAC games have been done, or if the total game number reaches twelve, the N.B game is over and the process returns to the first step ST1.

In the preferred embodiment, certain symbol combinations (group [C] of FIG. 3) become small hit prize modes during the regular game (non-bonus game) of the B.B game, although those combinations are regarded as non-prize modes in the ordinary regular game out of the B.B game. These prize combinations are new to the player because they occur as a prize game mode only after the game shifts to the B.B game. This gives an excitement to the player, and the player can enjoy variety in the game.

Although the invention was described with an example of slot machine, the invention is not limited to this example. The invention is applicable to many other game machines, for example, to a pinball game machine, other slingshot game machines, or a poker game machine. Although, in the embodiment, the variable display is a mechanical display consisting of the mechanically driven reels, the variable display may be composed of electrical display, such as liquid crystal, LED, CRT, etc. Furthermore, any number of symbols composing a symbol column, and any number of symbol columns may be selected without spoiling the advantage of the invention. It is apparent for those skilled in the art that many changes and modifications can be made without departing from the spirit and scope of the invention, as clear from the following claims.

What is claimed is:

1. A slot gaming machine operable in plural prize modes comprising:

a plurality of symbols representative of the plural prize modes;

a display for displaying the plurality of symbols; and a controller for selecting a symbol from said plurality of symbols according to a prize mode determined by a randomly selected number, stopping said selected symbol, and displaying said selected symbol on said display;

wherein said controller executes (i) a game according to a first game mode in which a variety of prizes occur, and changes to a first bonus mode having plural rounds of first bonus mode games in which a first predetermined hit occurs with a higher probability than during said first game mode and a second predetermined hit occurs only during said first bonus mode, (ii) a number of bonus games in which a jackpot prize occurs and more game media are paid than during a first bonus mode game of said plural rounds of first bonus mode games, and (iii) changes to a second bonus mode game which allows one bonus game of said number of bonus games to be played; and wherein said controller operates in an additional prize mode during said first bonus mode game which does not occur during said first game mode and occurs during said first bonus mode game.

2. A machine according to claim 1, wherein said number of bonus games occurs when a predetermined combination of prize symbols appears and stops on said display during said first bonus mode game in said first bonus mode.

3. A machine according to claim 2, wherein said first bonus mode is over when a total number of said first bonus mode games in said first bonus mode reaches a predetermined number, or when predetermined sets of said first bonus mode games and said number of bonus games was performed.

4. A slot machine according to claim 1, wherein said number of bonus games is over when a predetermined number of games have been played, or when said jackpot prize has occurred a predetermined number of times.

5. A machine according to claim 1, further comprising:

a read only memory for storing prize determination tables, each being defined by a game mode and a number of inserted game media and each containing comparison references for grouping a given range of random numbers into respective prize modes; and a sampling circuit for arbitrarily selecting a random number among generated random numbers;

wherein said controller reads a prize determination table from said determination tables defined by said game mode and said number of inserted game media from said read only memory, stores said prize determination table in a random access memory for a reference, and compares a comparison reference stored in said prize determination table in said random access memory with said random number selected by said sampling circuit to determine a prize mode.

* * * * *